US005103990A

United States Patent [19]

Irwin

[11] Patent Number: 5,103,990

[45] Date of Patent: Apr. 14, 1992

[54] CLOSURE FOR SINGLE SERVICE BEVERAGE CONTAINER

[75] Inventor: Christopher Irwin, Adrian, Mich.

[73] Assignee: Hoover Universal, Inc., Plymouth, Mich.

[21] Appl. No.: 604,109

[22] Filed: Oct. 29, 1990

[51] Int. Cl.[5] ..... B65D 41/58

[52] U.S. Cl. ..... 215/320; 215/212; 215/232; 215/235; 215/256; 215/321; 220/240; 220/276; 220/307; 220/339; 220/359

[58] Field of Search ..... 215/320, 271, 316, 212, 215/325, 256, 232, 235, 321, 258; 220/359, 240, 306, 339, 270, 307, 276

[56] References Cited

U.S. PATENT DOCUMENTS

| | | | |
|---|---|---|---|
| 1,607,091 | 11/1926 | Lucas | 215/325 |
| 1,645,316 | 10/1927 | Booth et al. | 215/325 |
| 2,483,586 | 10/1949 | Limpert | 215/235 |
| 3,417,897 | 12/1968 | Johnson | 220/339 X |
| 4,157,764 | 6/1979 | Moller | 220/240 |
| 4,281,774 | 8/1981 | Mumford | 215/256 |
| 4,376,493 | 3/1983 | Gall | 220/309 X |
| 4,428,497 | 1/1984 | Julius et al. | 220/339 |
| 4,574,975 | 3/1986 | Taylor et al. | 220/306 |
| 4,632,271 | 12/1986 | Taylor et al. | 220/306 X |
| 4,793,510 | 12/1988 | Arfert et al. | 220/306 |
| 4,867,336 | 9/1989 | Stewart | 220/359 |
| 4,938,390 | 7/1990 | Markva | 215/232 |

FOREIGN PATENT DOCUMENTS

| | | | |
|---|---|---|---|
| 698766 | 10/1953 | France | 215/325 |

*Primary Examiner*—Stephen P. Garbe
*Assistant Examiner*—Paul A. Schwarz
*Attorney, Agent, or Firm*—Harness, Dickey & Pierce

[57] ABSTRACT

A single service container having a hollow body and a cap with a portion extending interiorly of the body. The cap is mounted to seal a wide mouth style of opening formed at the upper end of the body. Interiorly of the mouth, a portion of the cap extends downwardly so as to cooperate with the positive internal pressure of the container and assist in sealing the cap on the body. A conical ring is formed on the periphery of the dome and engages an undercut interior surface adjacent to the mouth. The container further includes means for sealingly engaging the perimeter of the mouth. To open the container, a pulling member is pulled thereby severing the sealing engagements between the cap and the mouth, releasing the internal pressure and opening the container.

9 Claims, 3 Drawing Sheets

CLOSURE FOR SINGLE SERVICE BEVERAGE CONTAINER

BACKGROUND OF THE INVENTION

The present invention relates generally to the field of containers. More particularly, this invention relates to single service beverage containers exhibiting internal pressures greater than the ambient pressure. Such containers are typically used with carbonated beverages.

Various types and styles of containers and caps have been used where the internal pressure of the container exceeds that of the surroundings. Containers exhibiting positive internal pressures are commonly encountered in the field of carbonated beverages and typically employ either a "pop-top" or removable cap. Typical of those containers having a plastic cap, is that the cap is "torn-off" or separated from a member which indicates whether the container has been tampered or previously opened.

One common variety of the caps used in the above situation is the threaded cap. This cap exhibits threads on the interior of a skirt portion that extends downwardly over a threaded neck portion of the container body. In these containers, the cap is frictionally engaged and retained by the threads to the neck of the bottle. Generally, an indicating ring is provided at the lower end of the cap. The ring separates from the cap when the container is opened and thereby indicates tampering.

While the above style caps work well with narrow necked container bodies or bottles, these caps have not been successfully applied to a wide-mouthed plastic can-type of container.

With this in mind it is an object of the present invention to provide a novel container for use in positive internal pressure applications, particularly with carbonated beverages.

An additional object of this invention is to provide a closure cap for wide mouthed container bodies.

It is an object of the invention to produce a container having indicia for evidencing tampering with the container.

Another object of the invention is to produce a single service container wherein the cap remains attached to the container body once the container has been opened.

It is a further object of the present invention to provide a container wherein the internal pressure of the container cooperates with the cap to assist in sealing the container.

In view of these above objects, the present invention provides for a plastic container having a hollow body with a mouth formed at its upper end and a closure cap which engages the mouth to seal the container.

Formed on the interior of the mouth is a conical or tapered annular surface which generally narrows in the outward direction of the opening formed by the mouth. Extending generally toward the interior of the container body, the centralmost portion of the cap is a generally downwardly concave domed portion which terminates at its perimeter in a frustro-conically shaped ring. The frustro-conical ring engages the tapered surface of the mouth's interior. The closure cap is mounted to the container body by a snap-on type of engagement. Prior to mounting, the cap is in a generally inverted or cup shaped position. In otherwords, a skirt depending from the frustro-conical ring extends upward therefrom resulting in what has been referred to as an "over-center" sealing mechanism. In mounting, the cap is positioned over the mouth of the container body and the skirt is moved from its upward extending position to a downward extending position causing the cap to tighten itself into a sealing engagement on the mouth. Once mounted, the internal pressure of the container urges the domed portion upward causing the frustro-conical ring to engage the tapered surface of the mouth in substantially surface to surface contact thereby assisting in sealing the container.

Also included on the cap, and in particular the skirt portion, is an indicia mechanism for indicating whether the container has been previously opened or subjected to tampering. In one embodiment, a tear strip is circumferentially provided in the skirt. In opening the container, the tear strip is permanently severed from the skirt around the neck of the bottle. The torn strip readily indicates if the container has been tamper with or previously opened.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE DRAWINGS

Figure 1:
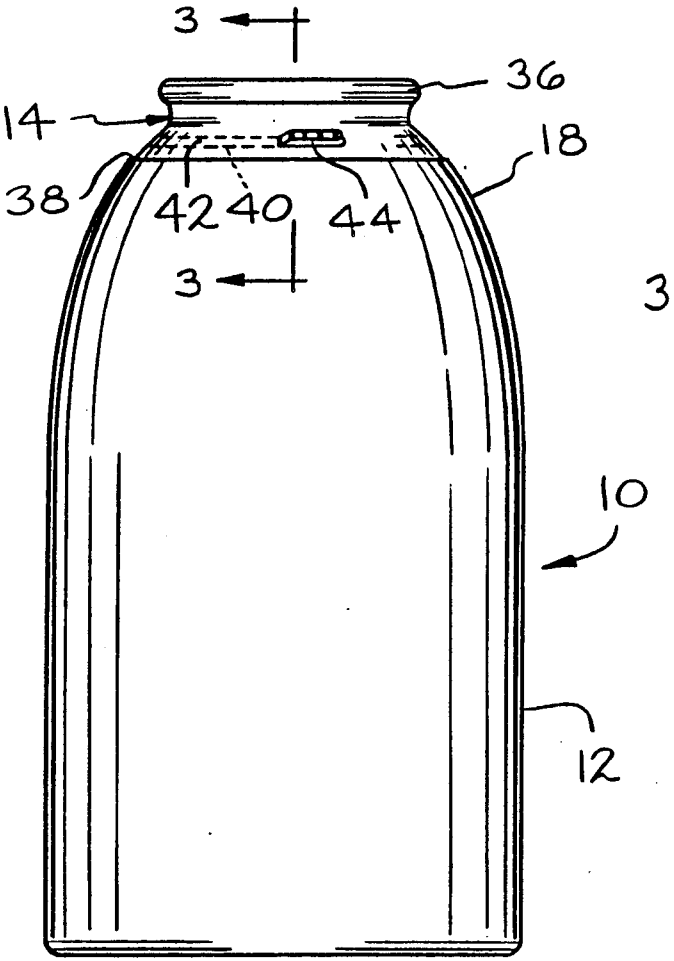
FIG. 1 is a side elevational view of a container incorporating the principles of the present invention.
Figure 4:
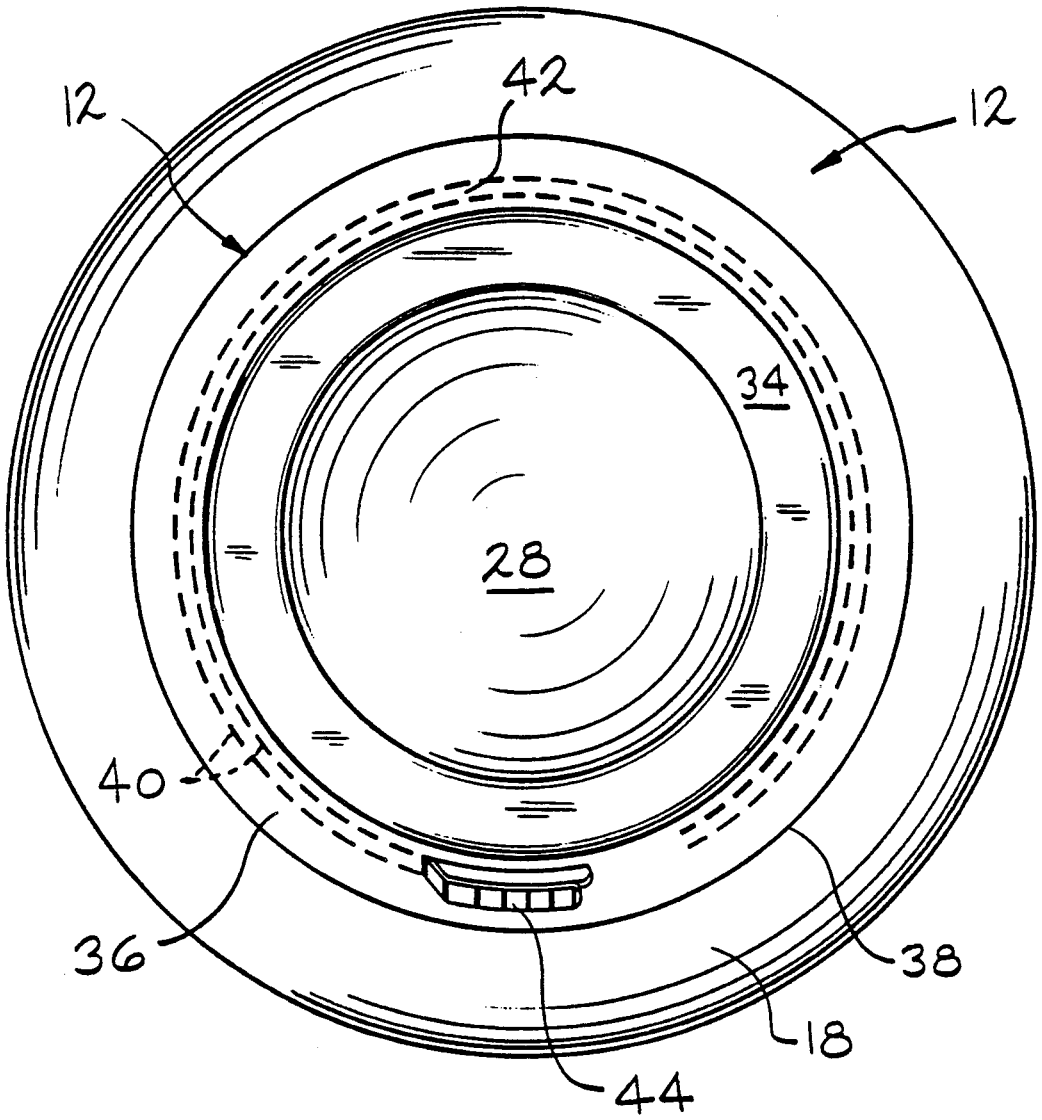
FIG. 4 is a plan view of the container shown in FIG. 1.

Now with reference to the drawing, a container embodying the principles of the present invention is generally designated at 10 in FIG. 1. The container 10 generally includes a hollow container body or bottle 12 and a closure cap 14. The cap 14 is mounted over a mouth 16, formed in the upper end of the bottle 12, and mechanically seals the container 10.

Figure 6:
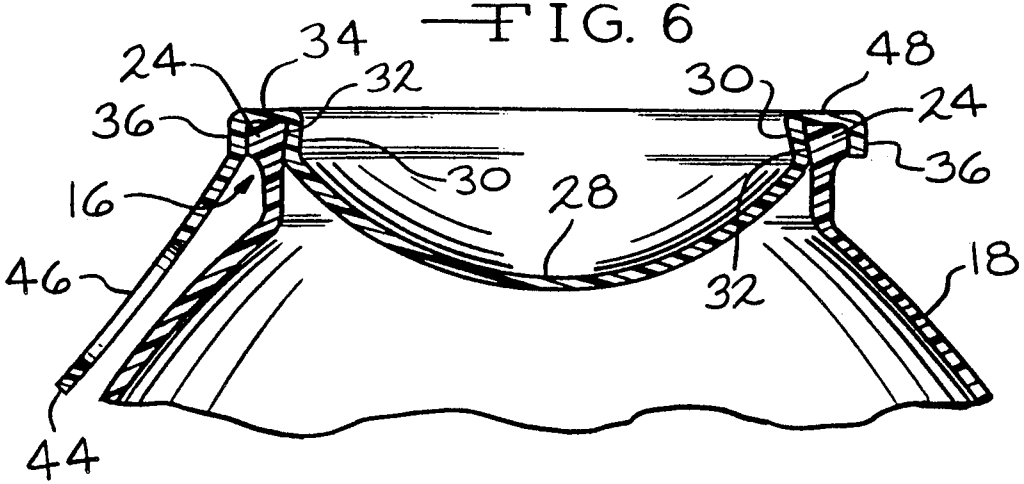
FIG. 6 is a sectional view of a portion of the container in FIG. 5 showing the cap assembled on the container body.
Figure 7:
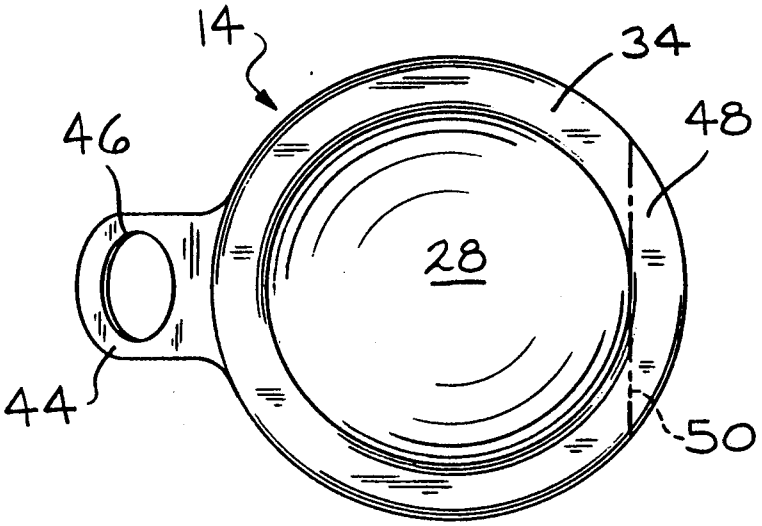
FIG. 7 is a plan view of the cap seen on the container in FIG. 5.
Figure 5:
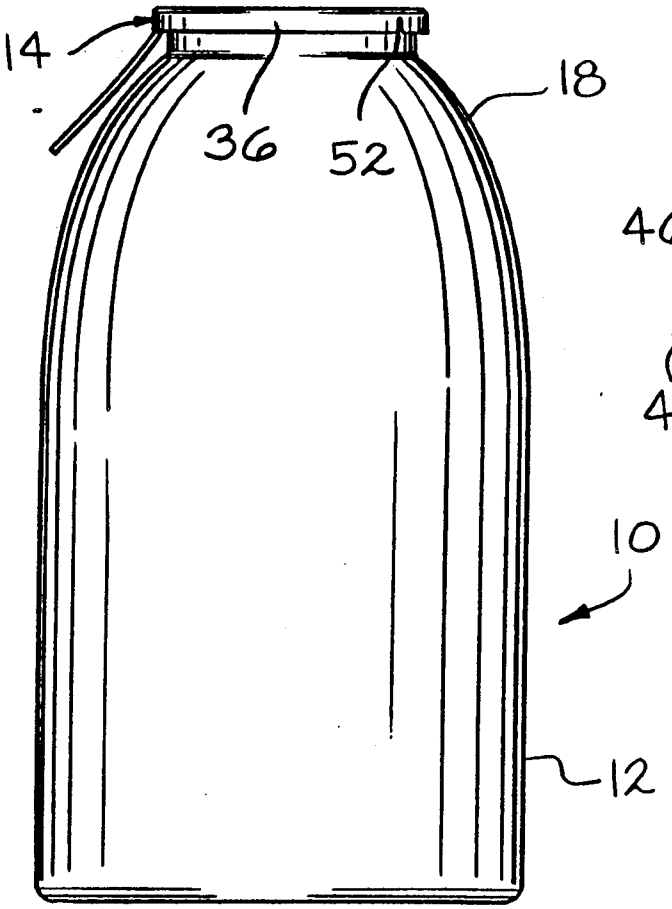
FIG. 5 is a side elevational view of a second embodiment incorporating the principles of the present invention.

Two embodiments of the present invention are disclosed and illustrated in the drawings. The first embodiment is illustrated in FIGS. 1–4, while the second embodiment is illustrated in FIGS. 5–7. Where appropriate, like elements are designated with like numbers.

The present invention is designed to be used when the internal pressure of the container 10 will be greater than the surrounding pressure. With this in mind, the invention will most likely find its greatest utility when used in conjunction with carbonated beverages. However, it will be appreciated that the invention may also be employed in various other applications, including the packaging of non-carbonated beverages under a vacuum or at atmospheric pressure.

The container 10 can be constructed from various materials and formed by using various methods not within the purview of this invention. In the preferred embodiment, the bottle 12 is blow molded from a plastic, such as polyethylene teraphalate (PET), into a thin walled configuration to molecularly orient the bottle material. The cap 14 is preferably constructed out of a somewhat flexible and resilient plastic, such as PET, which allows for common thermoforming techniques to be used.

The mouth 16 of the bottle 12 is generally configured in what is known as a "wide-mouth" shape, so named because the diameter of the mouth 16 opening approximates the overall or cross sectional size of the bottle 12. It is believed that the principles of the present invention also have application to bottles exhibiting smaller diameter mouths.

The mouth 16 is generally annular and extends upward from a neck region 88 which both narrows and lengthens from the container side walls to the mouth 16. The terminal upper end of the mouth 16 is defined by a generally annular seating ring 22 which forms the uppermost surface of the mouth 16. Positioned exteriorly adjacent to the seating ring 22 is an outwardly directed bead or lip 24 whose purpose will hereinafter become apparent. The inner surface 32 of the mouth 16 is tapered so as to exhibit a diameter narrowing in a direction outwardly of the bottle 12. In this manner, the inner surface 32 of the mouth 16 is generally frustro-conically shaped and undercuts the seating ring 22.

The cap 14 of the first embodiment, as seen in FIGS. 1–6, includes a downwardly concave central dome portion 28 which extends generally toward the interior of the bottle 12. The dome 28 thus exhibits an outward facing concavity when viewed from a position exteriorly of the mouth 16.

Extending upward from the perimeter of the dome 28 is an integrally formed frustro-conical ring 30. The ring 30 narrows in the outward direction of the bottle 12 and is correspondingly shaped to the interior surface 32 of the mouth 16.

The cap 14 further includes an annular sealing ring 34 and a depending skirt 36. The sealing ring 34 extends from the end of the frustro-conical ring 30 and will engage the seating ring 22 of the bottle 12 in surface to surface contact when the cap 14 is fully mounted thereon. The skirt 36 extends from the sealing ring 34 and, as further described below, mechanically secures the cap 14 to the bottle 12.

Figure 3:
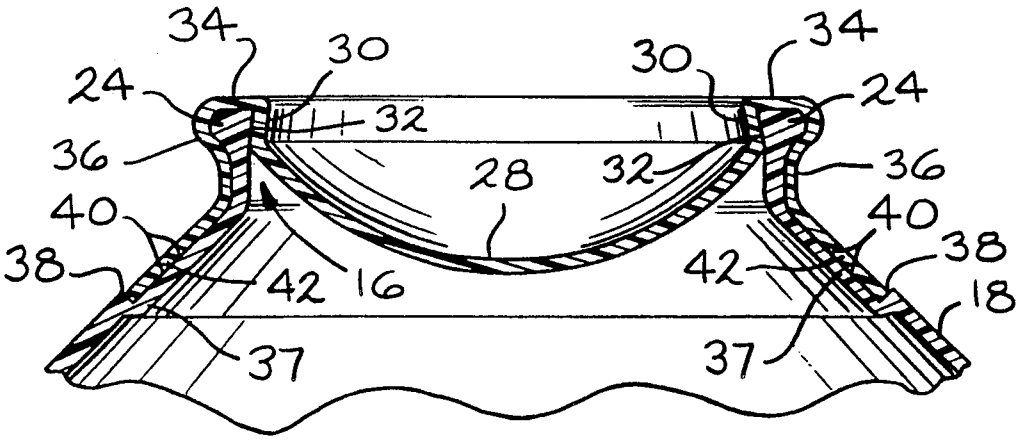
FIG. 3 is a sectional view taken substantially along line 3—3 in FIG. 1 showing the cap assembled onto the container body.
Figure 2:
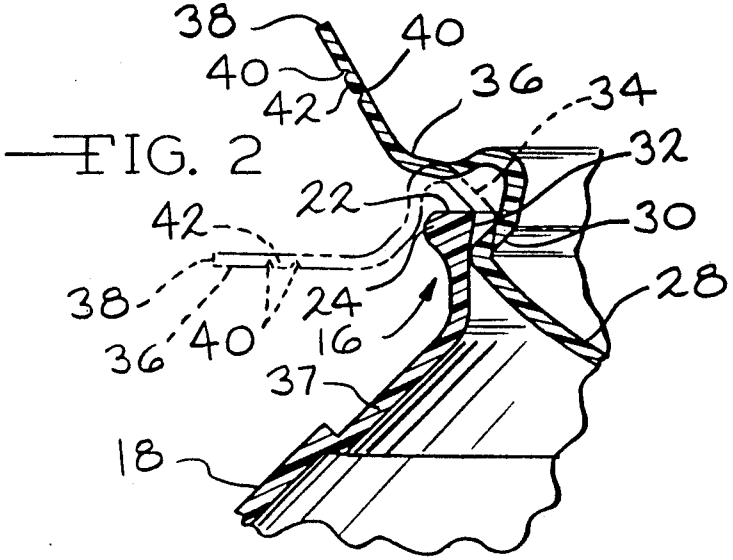
FIG. 2 is a sectional view showing a portion of the container prior to the cap being assembled onto the container body.

In the first embodiment, the original thermoformed shape, prior to assembly, of the cap 14 is generally cup shaped with the skirt 36 extend generally upward from the remainder of the cap 14. Approximately one half of the cupped position of the cap 14 can be seen in FIG. 2. The "cupped" cap 14 is positioned over the mouth 16 of the bottle 12 so that a portion of the frustro-conical ring 30 of the cap 14 will engage the undercutting interior surface 32 of the mouth. The cap 14 is then generally inverted over itself (or about its center) by moving the skirt 36 from its cupped position, through the phantom position shown in FIG. 2, to the downward extending position seen in FIG. 3. In inverting the cap 14, the inherent tension of the skirt 36 causes it to snap-fit over the lip 24 and be retained in engagement downward along the neck 18 of the bottle 12 until resting and terminating in a recessed portion 37. The terminal end 38 of the skirt 36 can be flush with the remainder of the neck 18 or reset within the recessed portion 37 as seen in FIG. 3.

The resiliency and tension exhibited by the skirt 36 causes the sealing ring 34 and the frustro-conical ring 30 to be respectively pulled into surface to surface contact and engagement with the seating ring 22 and the interior surface 32 of the mouth 16. If desired, the terminal end 38 of the skirt 36 may then be tack welded or adhesively secured to the neck 18 adjacent to the recessed portion 37 thereby further ensuring that the cap 14 is securely mounted and retained on the bottle 12.

Once the cap 14 has been mounted, the dome 28 will cooperate with the frustro-conical ring 30 and the inner mouth surface 32 to assist in sealing the container 10. The internal pressure of the container 10, typically 70 psi with a carbonated beverage, causes the dome 28 to be urged outward of the bottle 12. However, the undercutting surface 32 of the mouth 16 engages the perimeter of the dome 28 and prevents the outward movement. Instead, the dome 28 induces a laterally oriented component of force on the inside of the mouth 16 which causes the frustro-conical ring 30 to engage with the undercut interior surface 32.

With the terminal end 38 reset within the recessed portion 37 of the neck 18, the cap 14 is not susceptible to being grasped by the terminal end 38 and reinverted for opening of the container. If the terminal end 38 has been tack welded to the neck 18, this is not possible. For convenience in opening the container 10, a pair of tear notches or score lines 40 are formed into the surface of the skirt 36. The score lines can be coined, pressed, stamped or otherwise formed into either the exterior or interior surface of the skirt 36. Preferably, the score lines 40 are formed so as to be concealed once the cap 14 has been mounted onto the bottle 12.

Each score line 40 extends substantially, circumferentially along the skirt 36 so as to encircle the neck 18 of the bottle 12 and define a tear strip 42 which includes a pulling member 44 at one end. Since the score lines 40 represent weakened areas in the skirt 36, by grasping the pulling member 44 and pulling at a sharp angle relative to the tear strip 42, the score lines 40 will begin to fracture and separate the tear strip 42 from the remainder of the skirt 36. While the score lines 40 are weakened areas, they retain sufficient strength to resist fracturing during inversion of the skirt 36 over itself. It should also be noted that the score lines 40 do not completely encircle the neck 18 and thereby prevent the tear strip 42 and the remainder of the cap 14 from being completely severed from the lower portion of the skirt 36.

Once the tear strip 42 has been substantially separated from the skirt 36, the size of the skirt 36 is effectively reduced and the tension, caused by the inversion, is likewise effectively reduced. The tension is sufficiently reduced to enable finger pressure to push the remainder of the cap 14 out of engagement with the mouth 16 thereby opening the container 10.

With the skirt 36 being reset and tack welded or otherwise secured to the neck 18 of the bottle 12, no portion of the cap 14 becomes fully separated from the container 10 when it is opened and the potential for the cap 14 to be discarded as litter is reduced. Additionally, the bottle mouth 16 is protected from contact with dirt or other foreign substances until immediately prior to consumption of the beverage in the container 10. Furthermore, the pull member 44 provides the container 10 with an indicia for readily indicating tampering or prior opening.

As seen in FIGS. 5–7, a second embodiment of a container 10 incorporating the principles of the present invention is shown and includes a bottle 12 and a cap 14. As in the previous embodiment, the cap 14 includes a downwardly concave dome portion 28. Also like the previous embodiment, a frustro-conical ring 30 is integrally formed with the perimeter of the dome 28 and narrows in a direction outward of the bottle 12 cavity.

The internal pressure of the container 10 again exerts a force on the dome 28 in a direction generally outward of the bottle 12 and the perimeter of the dome 28, along with the frustro-conical ring 30, is engaged with an correspondingly shaped interior surface 32 of the mouth 16 which forms an undercut section beneath the seating ring 22. Also, a sealing ring 34 is connected to the frustro-conical ring 30 and a depending skirt 36 extend downward over the outwardly directed lip 24 to frictionally secure the cap 14 to the mouth 16.

As mentioned previously, the dome 28 cooperates with the internal pressure to assist in sealing the container 10. To further secured the container 10, the sealing ring 34 itself is circumferentially secured and sealed around the mouth 16 to the seating ring 22. This sealing is sufficient to withstand the internal pressures and may be accomplished by employing the various methods known within the industry, including adhesives, heat sealing, and radio frequency techniques.

Extending outward from one portion of the skirt 36 is a pulling member 44. The pulling member 44 of this second embodiment incorporates a finger opening 46 centrally therein, however, other gripping features could alternately be provided. Opposite from the pulling member 44, a section of the sealing ring 34 is permanently secured to the seating ring 22. This section, hereinafter a heat stake 48, is subjected to a sufficient amount of heat sealing so as to fixably weld the stake 48 onto the seating ring 22.

By lifting upward on the pulling member 44, the immediately adjacent portion of the skirt 36 is caused to separate from the lip 24 and the heat seal between the seating ring 22 of the bottle 12 and the sealing ring 34 of the cap 14 is fractured. Continued lifting of the pulling member 44 circumferentially severs the remainder of the seal except for the heat stake 48. While the sealing ring 34 is being disengaged from the seating ring 22, the adjacent portions of the frustro-conical ring 30 disengage the interior surface 32 of the mouth 16, releasing the internal pressure of the container 10. Once the pressure has been cracked open and released, the remainder of the dome 28 is readily disengaged.

The heat stake section 48 is defined in the sealing ring 34 by a groove or fold line 50. The fold line 50 is similar to the previously discussed score lines 40 in that it may be stamped, formed or coined into the sealing member 34. However, the fold line 50 is of sufficient strength to resist fracturing during opening of the container 10.

In the preferred embodiment, the size of the heat stake 48 is defined along its interior by the fold line 50 forming a tangent with the inner diameter of the sealing ring 34 and, along its exterior by an arc defining a portion of the outer diameter of the sealing ring 34. To readily permit the opened cap 14 to bend along the fold line 50, a notch 52 is provided in the skirt 36 adjacent to the opposing ends of the fold line 50.

Since the second embodiment is heat sealed around the sealing ring 34, any opening of the container 10 will cause the fracturing of this seal without the reinverting of the skirt 36. Subsequent engagement of skirt 36 with the mouth 18 of the bottle 12 will noticeably lack the heat seal thereby indicating any tampering or previous opening of the container 10.

In both embodiments the cap 14, like the bottle 12, can be constructed from various materials. Preferably the cap 14 is made from plastic, particularly, PET. As mentioned in the description of the first embodiment, the cap 14 can be formed from sheet stock through various thermoforming techniques. When extruded, a soft polyester gasket and/or adhesive gasket, may be provided with the cap 14 in those areas where the cap 14 contacts and seals the mouth 16 of the bottle 12. In another alternative, the cap 14 can be formed from co-extruded PET, thereby forming a multi-layered PET cap 14. As such, the cap's 14 strength could be provided by an exterior layer of biaxially oriented film, such as crystallized PET, and the cap's 14 sealing characteristics could be provided by an interior layer of amorphous PET, a structure suited to various heat sealing techniques.

While the above description constitutes the preferred embodiments of the present invention, it will be appreciated that the invention is susceptible to modification, variation and change without departing from the proper scope and the fair meaning of the accompanying claims.

What is claimed is:

1. A plastic closure cap assembly for sealingly engaging a beverage container having an annular mouth including a seating ring formed at the upper end of a hollow body and defining an opening, said cap assembly comprising a central portion including an interiorly directed body extending generally interiorly of the hollow body, said inwardly directed body including an inwardly concave dome having a perimeter for engaging an interior surface of the hollow body, an annular sealing ring being connected to said inwardly directed body, a securing member including a skirt portion integrally connected to said annular sealing ring and extending upwardly therefrom in a first position, said skirt portion being invertibly movable from said first position to a downwardly extending second position for moving said sealing ring into a sealed engagement with the seating ring and bringing said perimeter of said dome into sealing engagement with the interior surface of said hollow body thereby closing the opening formed therein and sealing the container, and means on said cap assembly for manually enabling the disengaging of said cap assembly from the mouth and thereby opening the container, said disengaging means including at least one score line formed in said skirt portion and substantially circumscribing the hollow body, said score line defining a tear strip having a pulling member at one end and being generally severable from said skirt portion enabling said cap assembly to be disengaged from the hollow body.

2. A cap assembly as set forth in claim 1 wherein said interiorly directed body includes a tapered annular ring integrally connecting said sealing ring to said dome, said tapered annular ring tapering in a direction inward of the hollow body and increasing in diameter until terminating at said perimeter of said dome and coacting therewith to close the container.

3. A cap assembly as set forth in claim 1 wherein said sealing ring is removably heat sealed to the hollow body.

4. A cap assembly as set forth in claim 3 wherein said sealing ring includes a fold line formed therein and defining a heat stake for fixably heat sealing said sealing ring to a portion of the mouth and retaining said cap assembly connected thereto after opening.

5. A cap assembly as set forth in claim 4 wherein said heat stake is oppositely positioned said pulling means.

6. A single service plastic container for contents packaged under pressure, said container comprising:

a hollow body defining an internal cavity and including a generally annular mouth formed at an upper end of said body, said mouth defining an opening extending therethrough permitting communication between said cavity and the surroundings, said mouth also having interior and exterior surfaces separated by a seating portion;

a closure cap having a central body in obstructing relationship with said opening to close said opening, said central body including a generally downwardly concave dome extending substantially interiorly of said hollow body toward said cavity and having a perimeter contacting a portion of said interior surface therearound, an annular ring connected to said dome and extending generally upward therefrom, a securement member formed integrally with said annular ring and including a skirt portion extending upwardly rom said annular ring in a first position, said skirt portion being invertibly movable from said first position to a downwardly extending second position along said exterior surface of said mouth to secure said cap in sealing engagement with said mouth closing said opening therein, movement of said skirt portion into said second position bringing said annular ring into surface-to-surface contact with said seating ring and allowing said dome to cooperate with the internal pressure of said container causing said perimeter to engage said interior surface and assist in sealing the contents within said container; and means for causing substantial disengagement of said cap from said mouth of said hollow body releasing the pressure and substantially unobstructing the opening formed therein, said disengaging means including at least one score line formed in said skirt and substantially circumscribing said hollow body, said score line defining a tear strip having a pulling member formed thereon and being generally severable from said skirt enabling said cap to be disengaged from said mouth.

7. A container as set forth in claim 6 wherein said interior surface of said mouth includes a tapered portion, said taper portion undercutting said opening by increasing the diameter of said opening inwardly thereof, said mouth also including an outwardly extending circumferential lip along said exterior surface.

8. A container as set forth in claim 7 wherein said cap includes a frustro-conical ring integrally formed at the perimeter of said dome, said frustro-conical ring being of increased diameter where formed with said dome and connecting said dome to said annular ring, said frustro-conical ring being brought into substantially surface to surface sealing contact with said tapered interior surface of said mouth in response to movement of said skirt portion into said second position.

9. A container as set forth in claim 6 wherein said plastic is polyethylene terapthalate (PET).

* * * * *